US008388261B1

(12) United States Patent
Lane

(10) Patent No.: US 8,388,261 B1
(45) Date of Patent: Mar. 5, 2013

(54) ROAD PLATE SECURING ASSEMBLY

(76) Inventor: Christopher Allen Lane, Medford, OR (US)

( * ) Notice: Subject to any disclaimer, the term of this patent is extended or adjusted under 35 U.S.C. 154(b) by 144 days.

(21) Appl. No.: 12/480,526

(22) Filed: Jun. 8, 2009

Related U.S. Application Data

(63) Continuation-in-part of application No. 12/006,137, filed on Dec. 31, 2007, now abandoned.

(51) Int. Cl.
*E01C 5/16* (2006.01)
*E02D 29/14* (2006.01)

(52) U.S. Cl. ..... 404/35; 404/25

(58) Field of Classification Search ..... 404/25, 404/35, 39; 40/741
See application file for complete search history.

(56) References Cited

U.S. PATENT DOCUMENTS 4,382,547 A * 5/1983 Phillips ..... 238/303
4,468,910 A * 9/1984 Morrison ..... 52/591.2
4,697,294 A * 10/1987 Schafer ..... 14/69.5
5,403,637 A * 4/1995 Pickard et al. ..... 428/44
5,640,821 A * 6/1997 Koch ..... 52/698
6,422,784 B1 * 7/2002 Pellegrino et al. ..... 404/17
6,520,714 B1 * 2/2003 Marsik, Jr. ..... 404/35
6,718,588 B1 * 4/2004 Frederiksen ..... 14/69.5
6,988,848 B2 * 1/2006 Arsenault et al. ..... 404/39
7,690,160 B2 * 4/2010 Moller, Jr. ..... 52/177
2002/0034418 A1 * 3/2002 Koch ..... 404/25
2006/0016136 A1 * 1/2006 Moller, Jr. ..... 52/177
2009/0169298 A1 * 7/2009 Lane ..... 404/25

* cited by examiner

*Primary Examiner* — Thomas B Will
*Assistant Examiner* — Abigail A Risic
(74) *Attorney, Agent, or Firm* — Jerry Haynes Law

(57) ABSTRACT

A road plate securing assembly for a roadway surface includes an assembly frame comprising a plurality of assembly frame members having various lengths and adapted for attachment to the roadway surface in end-to-end relationship with respect to each other, a plate opening defined by the assembly frame members and a plurality of road plates seated in the plate opening. A road plate securing method is also disclosed.

20 Claims, 7 Drawing Sheets

ROAD PLATE SECURING ASSEMBLY

CROSS-REFERENCE TO RELATED APPLICATIONS

This application is a continuation-in-part of and incorporates by reference in its entirety U.S. application Ser. No. 12/006,137, filed on Dec. 31, 2007 now abandoned and entitled "Road Plate Securing Assembly".

FIELD OF THE INVENTION

The present disclosure relates to roadway transition devices used in roadway repairs. More particularly, the present disclosure relates to a road plate securing assembly which secures a road plate over a construction or repair area on a roadway.

BACKGROUND OF THE INVENTION

Transition devices are commonly used in roadways under circumstances in which construction or repair to the roadway is being made. A conventional transition device may include asphalt or other paving material which is shaped into a temporary slope on the sides of the work area. After the road work has been completed, the asphalt or other paving material is removed. The conventional method of applying the asphalt or other paving material may be time-consuming, laborious and expensive.

SUMMARY OF THE INVENTION

The present disclosure is generally directed to a road plate securing assembly for a roadway surface. An illustrative embodiment of the road plate securing assembly includes an assembly frame comprising a plurality of assembly frame members having various lengths and adapted for attachment to the roadway surface in end-to-end relationship with respect to each other, a plate opening defined by the assembly frame members and a plurality of road plates seated in the plate opening.

The present disclosure is further generally directed to a road plate securing method. An illustrative embodiment of the road plate securing method includes providing a roadway having a roadway surface with a generally convex portion and an irregular shaped trench provided in the roadway surface; forming an assembly frame having a plate opening by providing a plurality of assembly frame members having various lengths and arranging the assembly frame members in end-to-end relationship on the roadway surface around the trench; placing a plurality of shims between the roadway surface and the assembly frame generally adjacent to the generally convex portion of the roadway surface; providing a plurality of road plates having various sizes and shapes; and resting the road plates on the plurality of shims in the plate opening and over the trench.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to implement the disclosure and are not intended to limit the scope of the claims. Furthermore, there is no intention to be bound by any expressed or implied theory presented in the preceding technical field, background, brief summary or the following detailed description.

Figure 1:
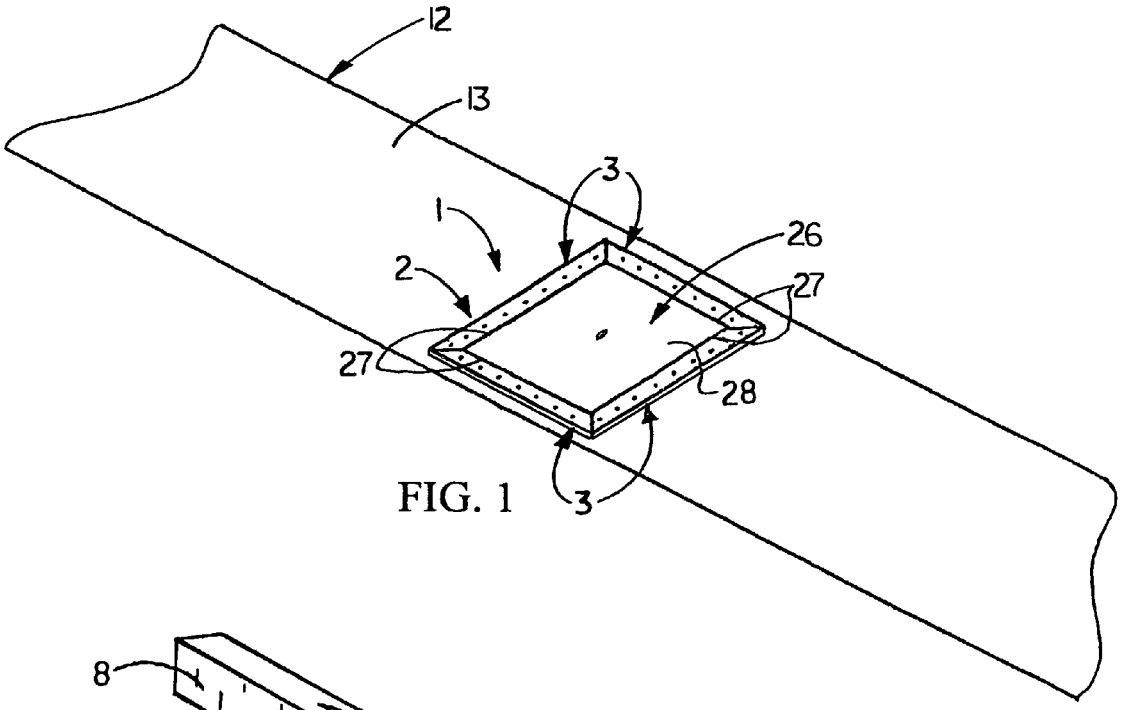
FIG. 1 is a perspective view of an illustrative embodiment of the road plate securing assembly, installed on a roadway.

Referring initially to FIGS. 1-5 of the drawings, an illustrative embodiment of the road plate securing assembly, hereinafter assembly, is generally indicated by reference numeral 1. As illustrated in FIG. 1 and will be hereinafter described, the assembly 1 is suitable for installation on a roadway surface 13 of a roadway 12 under circumstances in which repair or construction is carried out on the roadway surface 13. The repair or construction may include the formation of an access opening or openings (not illustrated) in the roadway 12 to facilitate access to piping, for example and without limitation.

The assembly 1 includes an assembly frame 2 which is assembled on the roadway surface 13 around the area of the roadway 12 on which the road work is carried out. The assembly frame 2 has a plate opening 22 (FIG. 2) through which the work area on the roadway 12 is normally exposed during repair or construction of the roadway 12. The plate opening 22 defined by the assembly frame 2 is adapted to receive a road plate 26 which covers the work area and facilitates traversal of vehicles (not illustrated) over the work area when the work area is not exposed.

Figure 2:
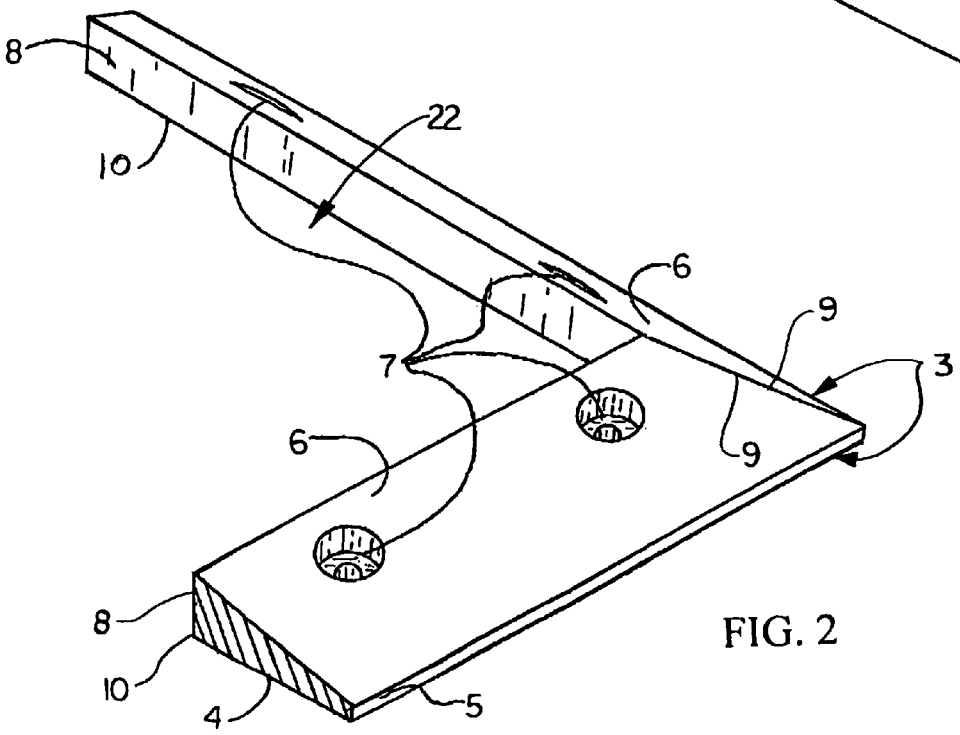
FIG. 2 is a perspective view, partially in section, of an assembly frame of an illustrative embodiment of the road plate securing assembly.

The assembly frame 2 of the assembly 1 includes multiple assembly frame members 3. In some embodiments, the assembly frame 2 includes four assembly frame members 3 which are arranged on the roadway surface 13 to form a generally square or rectangular assembly frame 2 having a correspondingly-shaped plate opening 22. Each assembly frame member 3 of the assembly frame 2 may be a metal such as steel, for example, or may be a suitable alternative material such as high-density plastic or a composite material, for example. Each assembly frame member 2 may be a highly-visible color such as bright orange, for example, to enhance visibility to motorists. As illustrated in FIGS. 2-5, each assembly frame member 3 may include a generally flat or planar lower surface 4; an outer edge 5 which extends in generally perpendicular relationship with respect to the lower surface 4; a generally sloped upper surface 6 which extends from the outer edge 5 and at an acute angle with respect to the lower surface 4; and a uni-planar inner surface 8 which extends from the lower surface 4 to the upper surface 6 and in generally parallel relationship with respect to the outer edge 5. A contact edge 10 is defined where the inner surface 8 joins the lower surface 4 of the assembly frame member 3. As illustrated in FIG. 2, each end of each assembly frame member 3 defines a mating surface 9 which is oriented at an acute angle with respect to a longitudinal axis of the assembly frame member 3. Multiple recessed fastener openings 7 may extend into each assembly frame member 3 at spaced-apart intervals with respect to each other.

Figure 3:
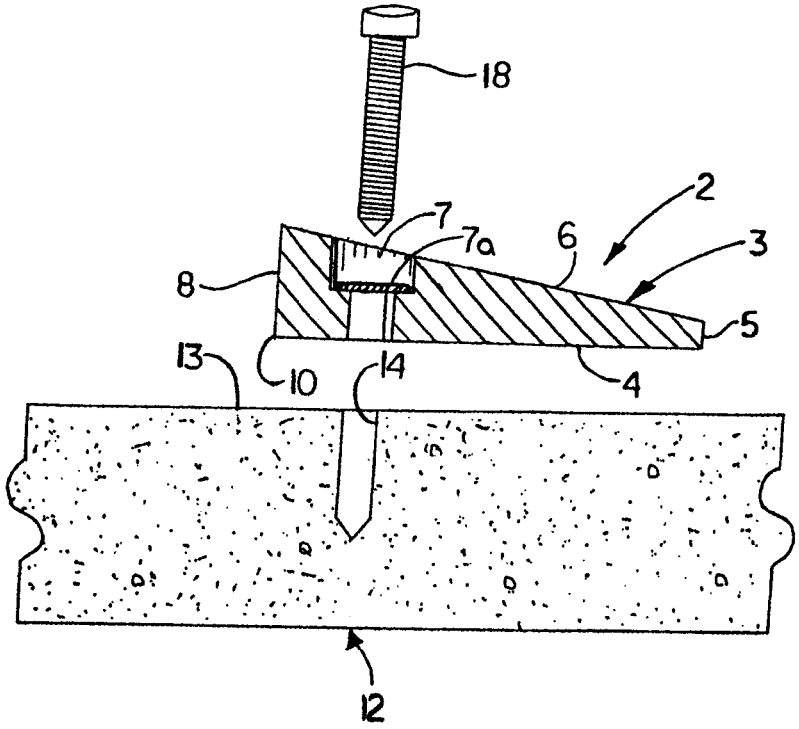
FIG. 3 is an exploded sectional view illustrating an exemplary fastener technique for attaching the assembly frame to a roadway surface of a roadway.
Figure 4:
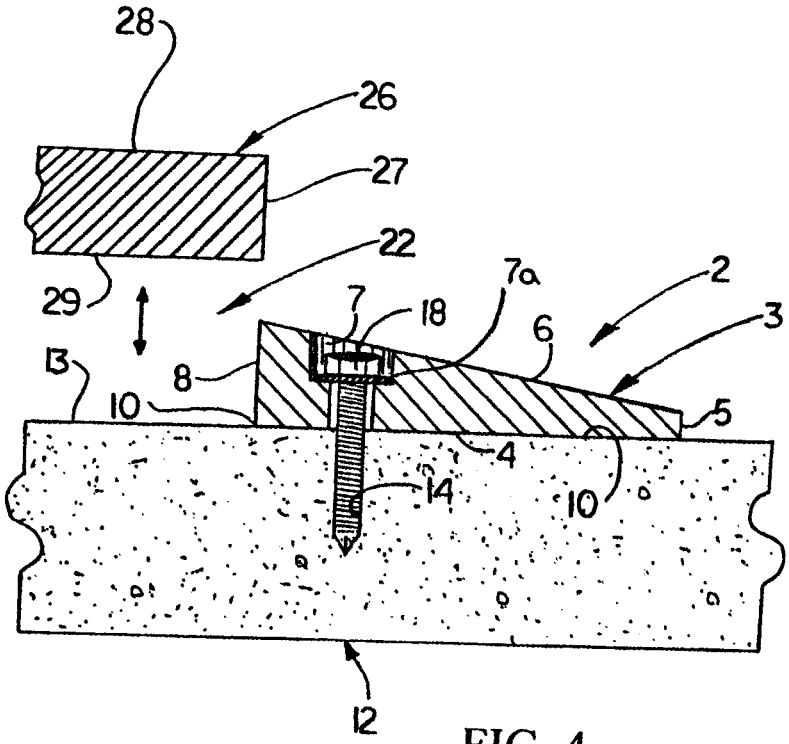
FIG. 4 is an exploded sectional view illustrating an exemplary technique for inserting a road plate in a plate opening defined by the assembly frame.
Figure 5:
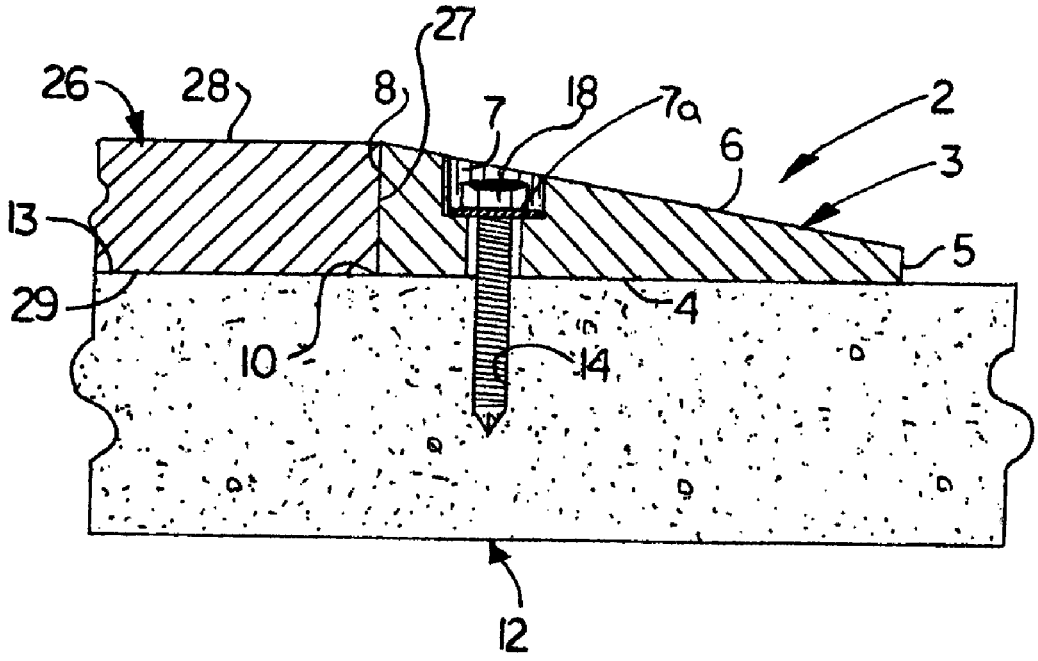
FIG. 5 is a sectional view of the assembly frame and the road plate seated in the plate opening defined by the assembly frame.

In typical application of the assembly 1, the assembly frame 2 is assembled on the roadway surface 13 of the roadway 12. Accordingly, the assembly frame members 3 are initially arranged on the roadway surface 13 such that the work area (not illustrated) on the roadway surface 13 is exposed through the plate opening 22. As illustrated in FIGS. 3 and 4, the lower surface 4 and contact edge 10 of each assembly frame member 3 contact the roadway surface 13 of the roadway 12. As illustrated in FIGS. 3 and 4, the assembly frame members 3 may be secured to the roadway surface 13 by extending a fastener 18 through each recessed fastener opening 7 and into a corresponding registering and underlying fastener opening 14 which may be pre-drilled into the roadway 12. As illustrated in FIGS. 3-5, washer 7*a* may be seated in each recessed fastener opening 7. Alternative techniques which are known by those skilled in the art may be used to attach each assembly frame member 3 to the roadway surface 13. As illustrated in FIG. 4, the inner surfaces 8 of the respective assembly frame members 3 face the plate opening 22 of the assembly frame 2. The plate opening 22 of the assembly frame 2 is sized to receive the road plate 26.

During repair or construction of the roadway 12, the road work is carried out within the confines of the plate opening 22 defined by the assembly frame 2. As illustrated in FIG. 5, when the roadwork is to be temporarily stopped, the road plate 26 is typically lowered to rest on the roadway surface 13. As illustrated in FIGS. 4 and 5, the road plate 26 may include plate edges 27 which are disposed into contact with or immediately adjacent to the inner surfaces 8 of the respective assembly frame members 3 of the assembly frame 2; an upper plate surface 28; and a lower plate surface 29 which rests directly on the roadway surface 13 of the roadway 12. Accordingly, when the road plate 26 is lowered in place in the plate opening 22, the upper surfaces 6 of the assembly frame members 3 provide transition surfaces for vehicles (not illustrated) as the vehicles traverse the road plate 26 over the work area. Repair or construction work on the roadway 12 can resume after lifting of the road plate 26 from the plate opening 22. It will be appreciated by those skilled in the art that the road plate 26 need not be unfastened from the roadway 12 or the assembly frame 2 prior to removal from the plate opening 22 since the road plate 26 rests directly on the roadway surface 13. Because the assembly frame members 3 of the assembly frame 2 hold the road plate 26 in place on the roadway surface 13, the road plate 26 may remain unfastened to the roadway 12 and the assembly frame 2 during use of the assembly 1. After use of the assembly 1 is completed, the assembly frame 2 may be detached from the roadway surface 13 typically by removing the fasteners 18 from the fastener openings 14 in the roadway 12 and the recessed fastener openings 7 in the assembly frame members 3.

Figure 6:
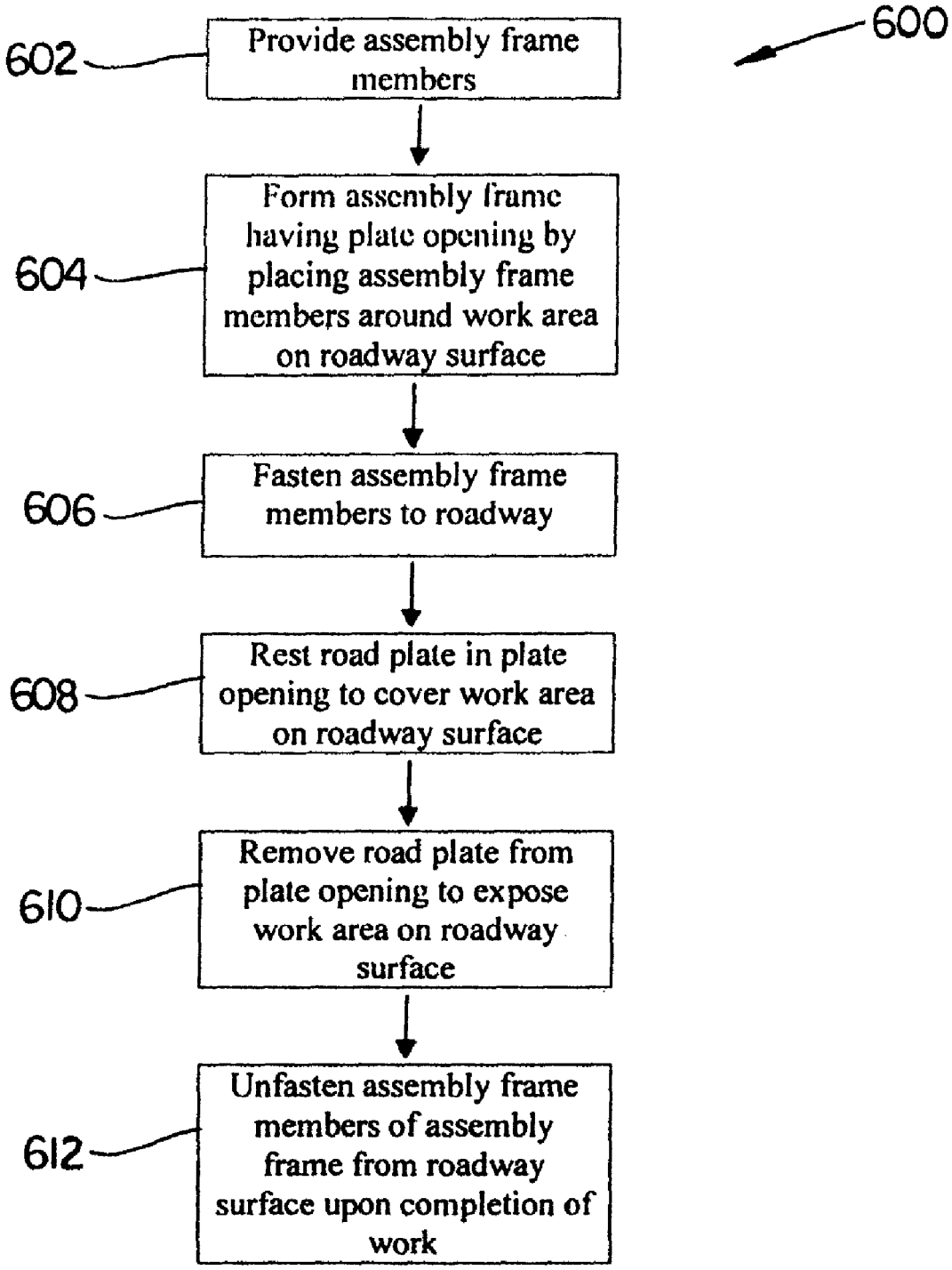
FIG. 6 is a flow diagram which illustrates an exemplary road plate securing method.

Referring next to FIG. 6 of the drawings, a flow diagram 600 which illustrates an exemplary road plate securing method is illustrated. In block 602, multiple assembly frame members are provided. In block 604, an assembly frame having a plate opening is formed by placing the assembly frame members around a work area on a roadway surface. In block 606, the assembly frame members of the assembly frame are fastened to the roadway. In block 608, a road plate is rested on the roadway surface in the plate opening to cover the work area on the roadway surface. In block 610, the road plate is removed from the plate opening to expose the work area on the roadway surface prior to resumption of the road work. In block 612, the assembly frame members of the assembly frame are unfastened from the roadway surface upon completion of the roadwork.

Figure 7:
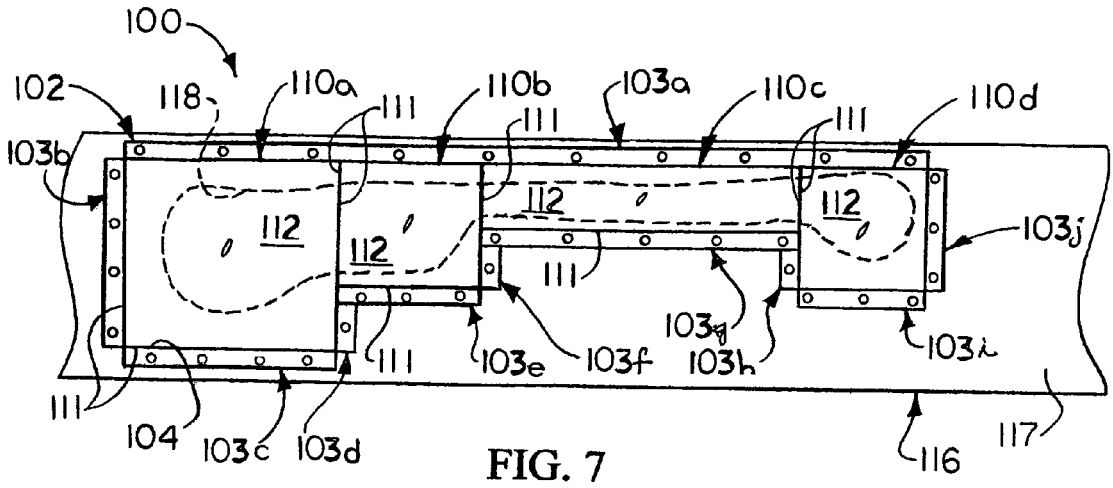
FIG. 7 is a top view of an alternative illustrative embodiment of the road plate securing assembly, installed on a roadway.
Figure 8:
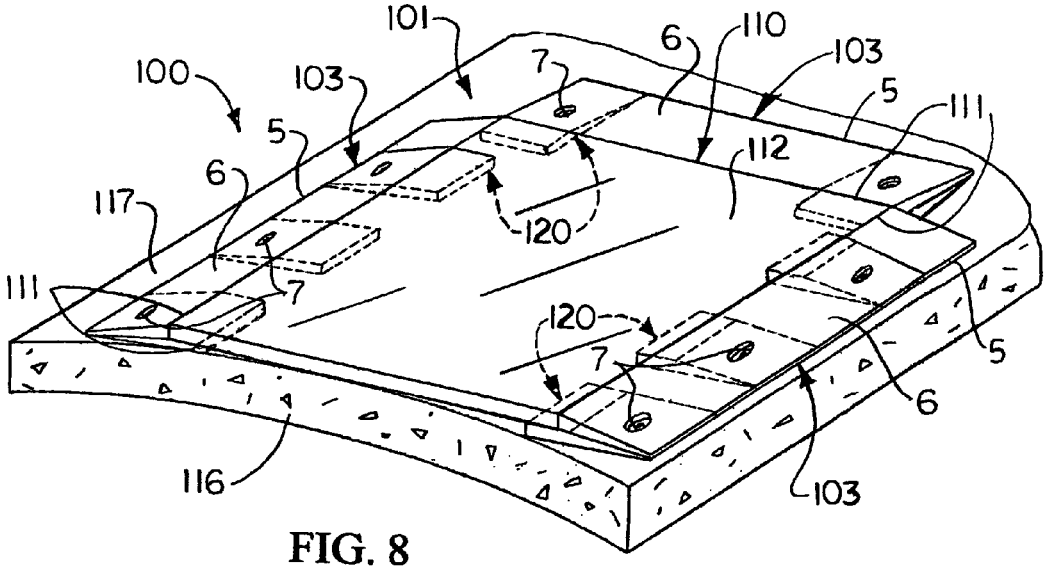
FIG. 8 is a perspective view of a portion of the alternative illustrative embodiment of the road plate securing assembly illustrated in FIG. 7, installed on a roadway having a convex roadway surface.

Referring next to FIGS. 7-10 of the drawings, an alternative illustrative embodiment of the road plate securing assembly, hereinafter assembly, is generally indicated by reference numeral 100. As illustrated in FIG. 7 and will be hereinafter described, the assembly 100 is suitable for installation on a roadway surface 117 of a roadway 116 under circumstances in which repair or construction is carried out on the roadway surface 13. In some applications, the repair or construction may include the formation of an access trench 118 (illustrated in phantom in FIG. 1) in the roadway 12 to facilitate access to subterranean utility piping, for example and without limitation. The assembly 100 may be particularly applicable to repair or construction scenarios in which the access trench 118 has a generally elongated and/or irregular shape. Moreover, the assembly 100 may be applicable to circumstances in which the roadway surface 117 of the roadway 116 has a generally convex shape or contour, as illustrated in FIG. 8 and will be hereinafter described.

Figure 9:
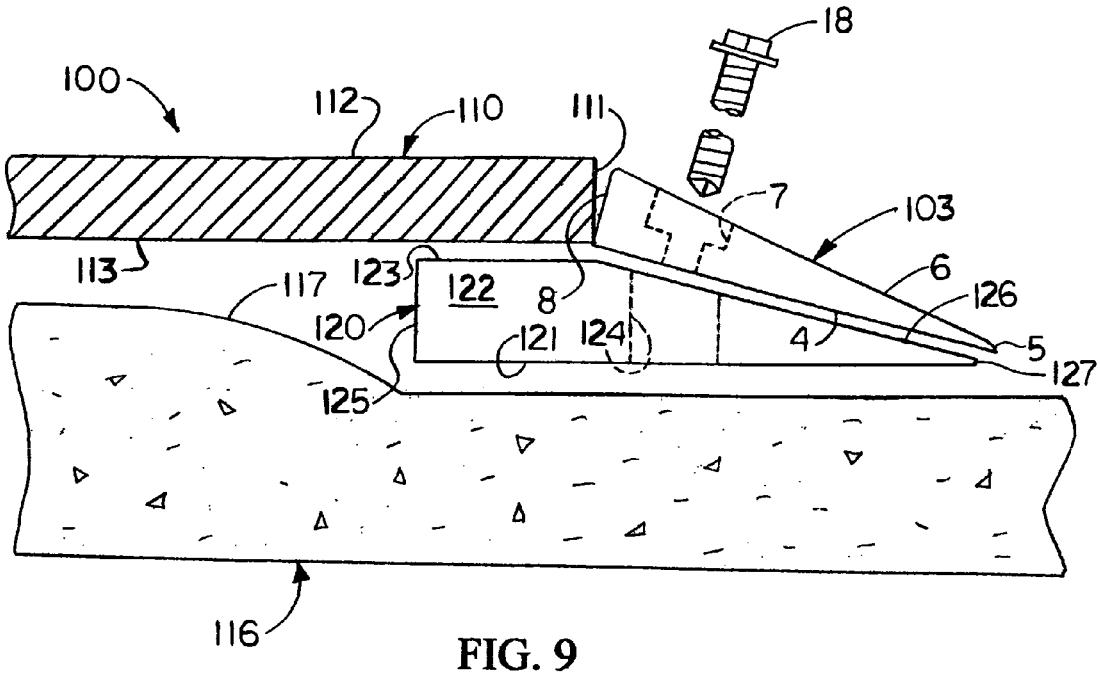
FIG. 9 is an exploded sectional view illustrating typical installation of the alternative illustrative embodiment of the road plate securing assembly on a roadway.
Figure 10:
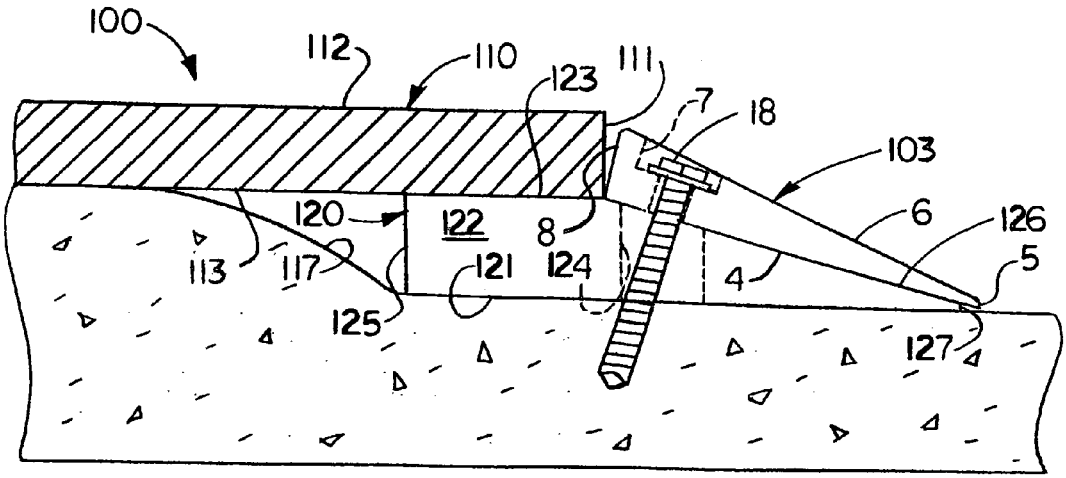
FIG. 10 is a sectional view of the alternative illustrative embodiment of the road plate securing assembly installed on a roadway.

As illustrated in FIG. 1, the particular size and configuration of the assembly 100 may be tailored to the size and shape of the access trench 118 which is to be covered by the assembly 100. The assembly 100 includes an assembly frame 102 which may generally demarcate the edges of the access trench 118. The assembly frame 102 may include multiple assembly frame members 103 which are generally laid end-to-end on the roadway surface 117 of the roadway 116 in surrounding relationship with respect to the access trench 118. In some embodiments, the assembly frame members 103 of the assembly frame 102 may be composed of rubber, fiberglass, or any type of plastic. The assembly frame members 103 may be a bright color such as orange, for example and without limitation, to enhance visibility of the assembly frame 102 and the assembly 100. As illustrated in FIGS. 9 and 10, each assembly frame member 103 of the assembly frame 102 may have characteristics which are the same as or similar to each assembly frame member 3 of the road plate securing assembly 1 which was heretofore described with respect to FIGS. 1-5. Each assembly frame member 103 of the assembly frame 102 may be secured to the roadway surface 117 of the roadway 116 by extending fasteners 18 through recessed fastener openings 7 (FIG. 9) provided in each assembly frame member 103 and threading the fasteners 18 into respective fastener openings (not illustrated) provided in the roadway surface 117, typically in the same manner as was heretofore described with respect to the road plate securing assembly 1 in FIGS. 1-5.

The assembly frame members 103 which are selected for construction of the assembly frame 102 may have different lengths at different locations within the assembly frame 102 depending on the length or width of the access trench 118 at the corresponding location of the assembly frame 102. By way of example, in some applications, the assembly frame 102 may include a first assembly frame member 103*a* which may be oriented in parallel relationship with respect to the longitudinal axis of the access trench 118 and may be longer than the access trench 118. Second-eighth assembly frame members 103*b*-103*i*, respectively, may be placed in end-to-end relationship with respect to each other generally around the perimeter of the access trench 118 to complete the assembly frame 102. The lengths of the assembly frame members 103 may be sufficient to route the assembly frame 102 into relative proximity to the irregular edge of the access trench 118 to minimize the area which is defined by the assembly frame 102. In some embodiments, the assembly frame members 103 may be prefabricated in various lengths. In other embodiments, the assembly frame members 103 may be cut to the desired lengths preparatory to assembly of the assembly frame 102. A plate opening 104 is defined by the assembly frame 102.

As further illustrated in FIG. 7, multiple road plates 110 may be placed on the roadway surface 117 of the roadway 116 within the plate opening 104 defined by the assembly frame 102 to cover the access trench 118. As illustrated in FIGS. 9 and 10, each road plate 110 may have plate edges 111; an upper plate surface 112; and a lower plate surface 113. The lower plate surface 113 of each road plate 110 is placed on the roadway surface 117 of the roadway 116, with the plate edges 111 of the road plate 110 facing the inner surface 8 of each corresponding assembly frame member 103 of the assembly frame 102.

The shapes and sizes of road plates 110 may be selected to span the corresponding areas of the assembly frame 102 in which the road plates 110 are placed. In the example illustrated in FIG. 7, the road plates 110 may include a first road plate 110*a* which is inserted between the first assembly frame member 103*a*, the second assembly frame member 103*b*, the third assembly frame 103*c* and the fourth assembly frame 103*d*; a second road plate 110*b* which is inserted between the first assembly frame member 103*a*, the fifth assembly frame member 103*e* and the sixth assembly frame member 103*f*; a third road plate 110*c* which is inserted between the first assembly frame member 103*a* and the seventh assembly frame member 103*g*; and a fourth road plate 110*d* which may be inserted between the first assembly frame member 103*a*, the eighth assembly frame member 103*h*, the ninth assembly frame member 103*i* and the tenth assembly frame member 103*j*. The first road plate 110*a*, the second road plate 110*b*, the third road plate 110*c* and the fourth road plate 110*d* may directly abut against each other in the assembly frame 102.

As illustrated in FIGS. 8-10, under circumstances in which the roadway surface 117 of the roadway 116 has a generally convex contour, shims 120 may be placed between the roadway surface 117 and each assembly frame member 103 of the assembly frame 102 to level the plane of the road plate or plates 110 of the assembly 100 to a substantially horizontal position. As illustrated in FIGS. 9 and 10, each shim 120 may include a generally planar lower surface 121; a pair of generally parallel side edges 122 (one of which is illustrated) extending from the lower surface 121; an upper surface 123 generally parallel to the lower surface 121; an inner surface 125 extending between the lower surface 121 and the upper surface 123 and between the side edges 122; and a beveled surface 126 which slopes downwardly from the upper surface 123 to an outer edge 127 which is opposite the inner surface 125. At least one fastener opening 124 (illustrated in phantom) may extend through the shim 120 from the beveled surface 126 to the lower surface 121.

As further illustrated in FIGS. 9 and 10, in typical assembly of the assembly 100, the shims 120 may initially be placed generally outside the edges of the convex portion of the roadway surface 117. At least two shims 120 may be placed in position to support each assembly frame member 103. The assembly frame member 103 of the assembly frame 102 may be placed on the beveled surface 126 of each shim 120. A fastener 18 may be extended through each recessed fastener opening 7 of the assembly frame member 103 and the underlying registering fastener opening 124 provided in the corresponding shim 120 and threaded into a corresponding fastener opening (not illustrated) provided in the roadway surface 117. The lower plate surface 113 of the road plate 110 may then be placed on the roadway surface 117 of the roadway 116 and the upper surface 123 of the shim 120. Therefore, the upper surface 6 of each assembly frame member 103 provides a sloped transition surface from the roadway surface 117 to the upper plate surface 112 of the road plate 110 and back onto the roadway surface 117. The assembly 100 may be disassembled and removed from the roadway surface 117 by reversing the steps described above.

Figure 11:
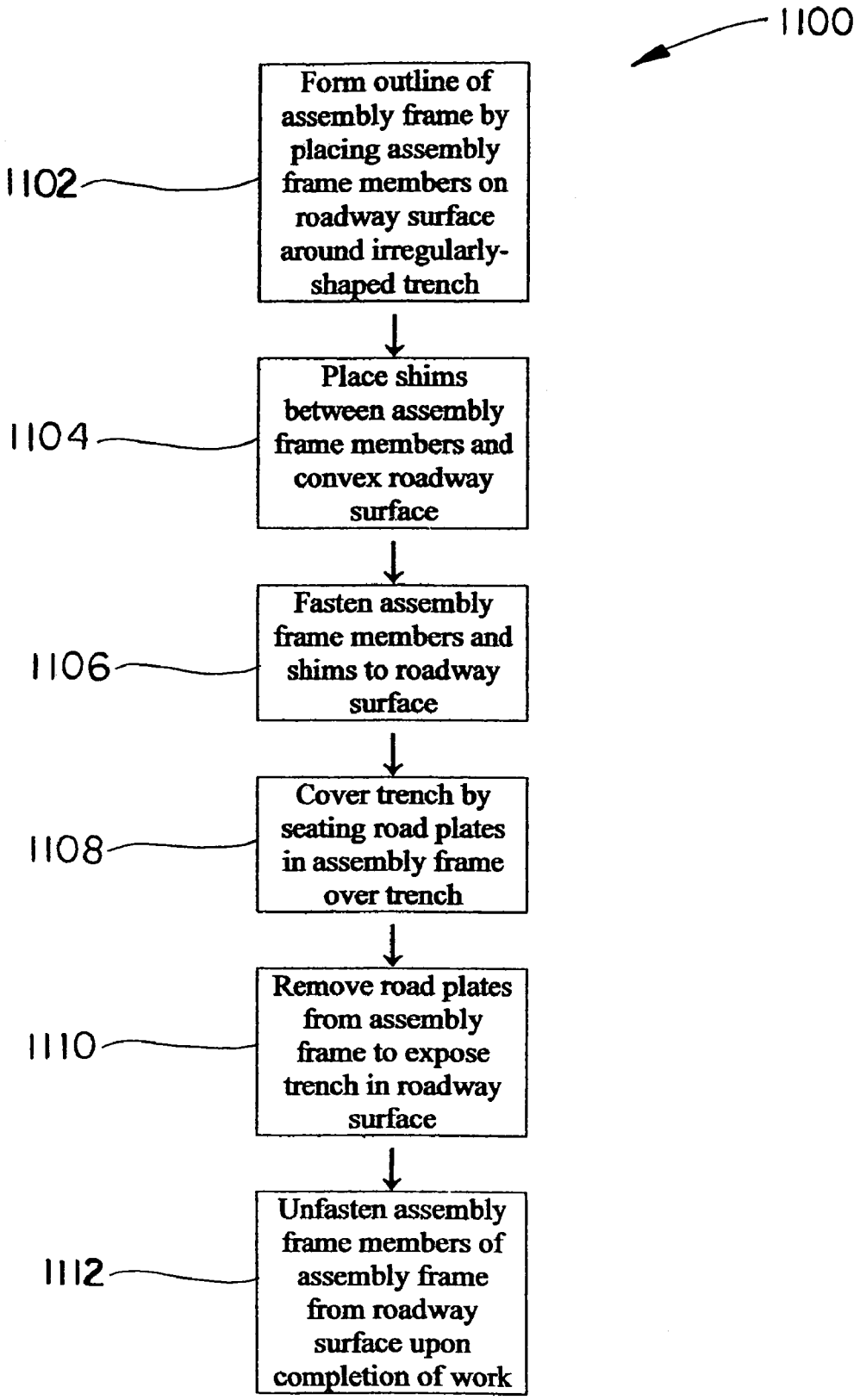
FIG. 11 is a flow diagram which illustrates an exemplary road plate securing method.

Referring next to FIG. 11, a flow diagram 1100 which illustrates an exemplary road plate securing method is illustrated. In block 1102, an outline of the assembly frame is formed by placing multiple assembly frame members on a roadway surface around an irregularly-shaped trench in the roadway surface. In block 1104, shims may be placed between the assembly frame members and the roadway surface. In block 1106, the assembly frame members and the shims may be fastened to the roadway surface. In block 1108, the trench may be covered by seating road plates in the assembly frame over the trench. In block 1110, the road plates may be removed from the assembly frame to expose the trench in the roadway surface. In block 1112, the assembly frame members of the assembly frame may be unfastened from the roadway surface upon completion of work.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A system for securing a road plate assembly over an irregularly shaped access trench in a roadway surface, comprising:

a discontinuous assembly frame comprising:

a plurality of straight assembly frame members having various lengths and adapted for attachment to the roadway surface in generally end-to-end relationship with respect to each other, each of the plurality of assembly frame members having a lower surface, an inner surface extending from the lower surface and an upper surface sloping from the inner surface, the inner surface substantially uni-planar from the lower surface to the upper surface;

a plate opening defined by the assembly frame members; and a plurality of road plates having various sizes and seated in the plate opening in abutting relationship to each other and at least partially resting on the roadway surface, the road plates unattached to the assembly frame; and wherein the assembly frame members and the road plates are selectable to customize the size and shape of the road plate assembly such that the outline of the road plate assembly substantially matches the outline of the access trench.

2. The road plate securing assembly of claim 1 wherein the inner surface faces a corresponding one of the plurality of road plates.

3. The road plate securing assembly of claim 2 further comprising an outer edge extending between the lower surface and the upper surface in generally parallel relationship with respect to the inner surface.

4. The road plate securing assembly of claim 1 further comprising a plurality of fastener openings extending through each of the assembly frame members at spaced-apart intervals with respect to each other.

5. The road plate securing assembly of claim 4 wherein the plurality of fastener openings comprises a plurality of recessed fastener openings.

6. The road plate securing assembly of claim 1 wherein the road plates abut against each other.

7. The road plate securing assembly of claim 1 further comprising a plurality of shims and wherein each of the plurality of assembly frame members is carried by at least one of the plurality of shims.

8. The road plate securing assembly of claim 7 wherein each of the plurality of shims comprises an upper surface and a beveled surface sloping from the upper surface, and wherein each of the plurality of road plates rests on the upper surface and each of the plurality of assembly frame members rests on the beveled surface of the at least one of the plurality of shims.

9. A system for securing a road plate assembly over an irregularly shaped access trench in a roadway surface, comprising:

a roadway having a roadway surface with a generally convex portion;

a plurality of shims provided on the roadway surface generally adjacent to the convex portion of the roadway surface;

a discontinuous assembly frame comprising a plurality of straight assembly frame members having various lengths and provided on the plurality of shims, each of the plurality of assembly frame members having a lower surface, an inner surface extending from the lower surface and an upper surface sloping from the inner surface, the inner surface substantially uni-planar from the lower surface to the upper surface, the plurality of shims forming a gap between the assembly frame and the roadway surface;

a plate opening defined by the assembly frame members of the assembly frame;

a plurality of road plates having various sizes and disposed in the plate opening and carried by the plurality of shims and at least partially resting on the roadway surface, the road plates unattached to the assembly frame; and wherein the assembly frame members and the road plates are selectable to customize the size and shape of the road plate assembly such that the outline of the road plate assembly substantially matches the outline of the access trench.

10. The road plate securing assembly of claim 9 wherein each of the plurality of shims comprises a lower surface engaging the roadway surface, a pair of spaced-apart side edges extending from the lower surface, an upper surface spaced-apart from and generally parallel to the lower surface, an inner surface extending between the lower surface and the upper surface and between the side edges, an outer edge spaced-apart from the inner surface and a beveled surface sloping from the upper surface to the outer edge, and wherein the at least one road plate engages the upper surface and the assembly frame engages the beveled surface.

11. The road plate securing assembly of claim 10 further comprising a first fastener opening extending through each of the plurality of shims and a recessed fastener opening extending through each of the plurality of assembly frame members and a fastener extending through the first fastener opening and the recessed fastener opening and into the roadway surface.

12. The road plate securing assembly of claim 11 wherein the first fastener opening extends between the beveled surface and the lower surface of each of the plurality of shims.

13. The road plate securing assembly of claim 10 wherein the inner surface of each of the assembly frame members generally faces a corresponding one of the at least one road plate.

14. The road plate securing assembly of claim 9 wherein the plurality of assembly frame members have various lengths and are disposed in end-to-end relationship with respect to each other and wherein the at least one road plate comprises a plurality of road plates having various sizes and shapes.

15. The road plate securing assembly of claim 14 wherein the road plates abut against each other.

16. A road plate securing method for securing a road plate assembly over an irregularly shaped access trench in a roadway surface, comprising:

providing a roadway having a roadway surface with a generally convex portion and an irregularly-shaped trench provided in the roadway surface;

forming a discontinuous assembly frame having a plate opening by providing a plurality of straight assembly frame members having various lengths and selecting and arranging the assembly frame members in generally end-to-end relationship on the roadway surface around the trench such that the outline of the assembly frame substantially matches the outline of the trench, each of the plurality of assembly frame members having a lower surface, an inner surface extending from the lower surface and an upper surface sloping from the inner surface, the inner surface substantially uni-planar from the lower surface to the upper surface;

placing a plurality of shims between the roadway surface and the assembly frame generally adjacent to the generally convex portion of the roadway surface;

providing a plurality of road plates having various sizes and shapes; and resting the road plates on the plurality of shims and at least partially on the roadway surface in the plate opening and over the trench in abutting relationship to each other, with the road plates remaining unattached to the assembly frame and the plurality of shims forming or filling a gap between the assembly frame and the roadway surface.

17. The method of claim 16 wherein placing a plurality of shims between the roadway surface and the assembly frame comprises placing a plurality of shims each having an upper surface and a beveled surface extending from the upper surface on the roadway surface, and wherein resting the road plates on the plurality of shims comprises resting the road plates on the upper surfaces of the plurality of shims, respectively, and placing a plurality of shims between the roadway surface and the assembly frame comprises placing the assembly frame on the beveled surfaces and the plurality of shims, respectively.

18. The method of claim 17 further comprising attaching the assembly frame members and the shims to the roadway surface.

19. The method of claim 18 wherein attaching the assembly frame members and the shims to the roadway surface comprises providing a plurality of fastener openings in each of the assembly frame members, the shims and the roadway surface and extending a plurality of fasteners through the plurality of fastener openings, respectively.

20. The method of claim 19 wherein providing a plurality of fastener openings in each of the shims comprises extending a fastener opening through the beveled surface of each of the shims.

* * * * *